US005687578A

United States Patent [19]

Cochran

[11] Patent Number: 5,687,578

[45] Date of Patent: Nov. 18, 1997

[54] HEAT PUMP APPARATUS AND RELATED METHODS PRODUCING ENHANCED REFRIGERANT FLOW STABILITY

[75] Inventor: Robert W. Cochran, Lakeland, Fla.

[73] Assignee: ECR Technologies, Inc., Lakeland, Fla.

[21] Appl. No.: 563,159

[22] Filed: Nov. 27, 1995

[51] Int. Cl.[6] ..... F25B 41/00

[52] U.S. Cl. ..... 62/113; 62/218; 62/222; 62/509

[58] Field of Search ..... 62/218, 222, 509, 62/513, 113

[56] References Cited

U.S. PATENT DOCUMENTS

| | | |
|---|---|---|
| 1,691,286 | 11/1928 | Hiller . |
| 1,805,700 | 5/1931 | King . |
| 1,830,022 | 11/1931 | Fourness . |
| 2,047,429 | 7/1936 | Philipp . |
| 2,081,845 | 5/1937 | Zwickl . |
| 2,089,851 | 8/1937 | McIntosh . |
| 2,133,962 | 10/1938 | Shoemaker . |
| 2,191,328 | 2/1940 | Steenstrup . |
| 2,215,717 | 9/1940 | Rea . |
| 2,258,450 | 10/1941 | Graham . |
| 2,276,814 | 3/1942 | Zwickl . |
| 2,333,296 | 11/1943 | Cocanour . |
| 2,977,773 | 4/1961 | De Kanter . |
| 3,324,671 | 6/1967 | Harnish . |
| 3,350,898 | 11/1967 | Harnish . |
| 4,259,848 | 4/1981 | Voight . |
| 4,546,616 | 10/1985 | Drucker . |
| 4,718,245 | 1/1988 | Van Steenburgh, Jr. . |
| 4,773,234 | 9/1988 | Kann . |
| 4,815,298 | 3/1989 | Van Steenburgh, Jr. . |
| 4,831,843 | 5/1989 | Cochran . |
| 5,331,827 | 7/1994 | Chlebak . |

OTHER PUBLICATIONS

Robert W. Cochran, "ECR Direct Expansion Earth Coupled Heat Pump System and Refrigerant Flow Control System".

*Primary Examiner*—Henry A. Bennett
*Assistant Examiner*—Susanne C. Tinker
*Attorney, Agent, or Firm*—Allen, Dyer, Doppelt, Milbrath & Gilchrist, P.A.

[57] ABSTRACT

A heat pump apparatus includes a liquid refrigerant flow control valve connected in fluid communication between a condenser and evaporator. The liquid flow control valve includes a refrigerant outlet tube connected in fluid communication with an expansion orifice and extends in thermal contact with an upper portion of the valve housing for controlling condensing of vapor refrigerant within the housing to thereby stabilize refrigerant flow. A float, movably positioned within the housing, cooperates with the expansion orifice for controlling a flow of refrigerant passing from the housing to the evaporator based upon a level of liquid refrigerant within the housing. When a large amount of vapor refrigerant arrives at the liquid flow control valve as a result of a control oscillation or system disturbance, the float moves downwardly, thereby reducing flow through the expansion orifice, cooling the outlet tube and causing vapor to condense more quickly in the housing. Conversely, when an oscillation or disturbance causes very little vapor to arrive at the liquid flow control valve, the liquid level rises in the housing and causes the float to rise. The expansion orifice releases more refrigerant, thereby increasing the pressure and temperature of the refrigerant outlet tube, and providing less cooling to the housing to slow vapor condensation. Method aspects of the invention are also disclosed.

42 Claims, 3 Drawing Sheets

REVERSING VALVE
COMPRESSOR
ACCUMULATOR

HEAT PUMP APPARATUS AND RELATED METHODS PRODUCING ENHANCED REFRIGERANT FLOW STABILITY

FIELD OF THE INVENTION

The present invention relates to the field of heating and air conditioning, and, more particularly, to an apparatus and related methods for controlling refrigerant flow in a heat pump apparatus.

BACKGROUND OF THE INVENTION

Heat pumps have become increasing popular because of the energy efficiency in transferring rather than creating heat. A heat pump typically includes a compressor which circulates refrigerant through a first heat exchanger or condenser, through an expansion valve or expansion orifice, through a second heat exchanger or evaporator, and into an accumulator. A heat pump can commonly be operated in either a heating or cooling mode by selective activation of a reversing valve.

Air source heat pumps which exchange heat with ambient air have been most common because of their generally low initial cost. Another type of heat pump is the ground-coupled heat pump which transfers heat with the ground through a heat exchanger commonly called an earth loop or earth tap. A ground-coupled heat pump is typically more efficient than an air source heat pump because the earth temperature may be more stable than ambient air.

Among the ground-coupled heat pumps are the direct expansion and closed loop types. The closed loop heat pump typically includes an intermediate fluid, such as an anti-freeze solution, which is circulated between one or more buried conduits and a heat exchanger as disclosed, for example, in U.S. Pat. No. 4,325,228. In other words, an extra stage of heat exchange is required in the closed loop heat pump.

The direct expansion heat pump circulates refrigerant directly through one or more earth tap heat exchangers, and may be more efficient than a closed loop heat pump. A typical U-shaped earth tap heat exchanger includes two parallel conduits joined in fluid communication at their adjacent lower ends. One conduit carries liquid refrigerant and the other vapor refrigerant. Coaxial or concentric tubes for liquid and vapor refrigerant are also disclosed, for example, in German Patent No. 3,203,526A.

U.S. Pat. No. 4,831,843 to Cochran and assigned to the assignee of the present invention discloses a significant advance in the area of heat pumps and, more particularly, relating to the control of liquid refrigerant in a heat pump. One aspect of the apparatus is the provision of a float-type refrigerant flow control valve which controls refrigerant flow from the condenser to the evaporator based upon a level of liquid refrigerant within the valve housing. The flow control valve helps to ensure that all refrigerant condenses to become liquid just as the refrigerant reaches the outlet of the condenser. The evaporator desirably receives only liquid refrigerant at its inlet and evaporation is desirably complete just as the refrigerant reaches the outlet. Preferably, no unevaporated refrigerant should leave the outlet of the evaporator. High operating efficiency may be achieved if these conditions are satisfied throughout operation of the heat pump.

Unfortunately, system conditions may vary widely during operation of a heat pump. For example, for an air source heat pump, a gust of wind may cause a several degree change in temperature of the refrigerant in the condenser within several seconds. Such a disturbance or oscillation may cause the relative proportions of vapor and liquid within the housing of a float-type control valve to vary widely. Accordingly, a typical float-type liquid flow control valve may considerably overshoot and/or undershoot control of liquid refrigerant flow, and thereby experience hunting or extreme oscillations so that a stable operating equilibrium is not reached and maintained after a system disturbance. Operating efficiency of the heat pump may suffer if refrigerant flow is not closely controlled throughout all operating conditions of a heat pump.

SUMMARY OF THE INVENTION

In view of the foregoing background, it is therefore an object of the present invention to provide a heat pump apparatus and associated method for facilitating stable operation despite changes in system conditions.

This and other objects, advantages and features of the present invention are provided by a heat pump apparatus comprising a liquid refrigerant flow control valve connected in fluid communication between the condenser and the evaporator, and wherein the valve includes a refrigerant outlet tube connected in fluid communication with an expansion orifice and positioned in thermal contact with an upper portion of the valve housing for controlling condensing of vapor refrigerant within the housing to thereby stabilize refrigerant flow. The housing contains liquid refrigerant and vapor refrigerant above the liquid refrigerant. In addition, orifice defining means is provided for defining the expansion orifice for the liquid refrigerant. A float, movably positioned within the housing, cooperates with the orifice defining means for controlling a rate of flow of refrigerant passing through the expansion orifice based upon a level of liquid refrigerant within the housing. Accordingly, the valve controls the flow of refrigerant from the condenser to the evaporator.

When a large amount of vapor refrigerant arrives at the liquid flow control valve as a result of a control oscillation or system disturbance, the float moves downwardly, thereby reducing flow through the expansion orifice. Accordingly, the pressure drops downstream from the liquid flow control valve in the refrigerant outlet tube and the temperature of the outlet tube is also lowered. The cooler outlet tube lowers the temperature of the upper portion of the housing which, in turn, more rapidly cools and condenses vapor within the housing, thereby more rapidly increasing the liquid level within the housing. In addition, the excess vapor increases the vapor-to-housing contact area within the housing further assisting the cooling and condensing of excess vapor. The liquid flow control valve thus quickly dissipates the excess vapor.

Conversely, when an oscillation or disturbance causes relatively little vapor to arrive at the liquid flow control valve, the liquid level rises in the housing and causes the float to rise. The expansion orifice releases more refrigerant, thereby increasing the pressure and temperature of the refrigerant outlet tube. The refrigerant outlet tube in this scenario less rapidly cools the upper portion of the housing and thus condenses vapor in the housing more slowly allowing the vapor in the housing to increase. The present invention provides a countering effect or negative feedback to oscillations or system disturbances that may otherwise cause large control swings or excessive hunting.

The refrigerant outlet tube preferably contacts an upper exterior surface of the housing. In addition, the refrigerant outlet tube preferably extends outwardly from a lower portion of the housing and extends upwardly and in spaced relation therefrom before contacting the upper exterior surface of the housing. The upper portion of the housing may be arcuate. In one embodiment, the housing may have a cylindrical shape with an axis aligned in a horizontal direction. The upper housing portion may have a predetermined radius of curvature, and the refrigerant outlet tube preferably contacts the arcuate upper portion of the housing along a length in a range of about ½ to 3 times the predetermined radius of curvature, and more preferably about two times the radius of curvature.

The float of the valve preferably comprises a body portion and a metering portion connected thereto. The metering portion may be pivotally connected to an interior of the housing.

The liquid flow control valve preferably further comprises a refrigerant inlet connected in fluid communication between the condenser and the housing via a refrigerant inlet tube. One of the condenser or evaporator may be a refrigerant-to-air heat exchanger or an earth tap heat exchanger positioned in soil or water, for example.

A method aspect of the present invention is for stabilizing refrigerant flow of a liquid refrigerant flow valve connected in fluid communication between a condenser and an evaporator of a heat pump apparatus. The liquid flow control valve comprises a housing for containing liquid refrigerant and vapor refrigerant above the liquid refrigerant, and a float movable within the housing for controlling a flow of refrigerant passing through the expansion orifice based upon a level of liquid refrigerant within the housing. The method preferably includes the steps of: connecting a refrigerant outlet tube in fluid communication with the expansion orifice, and positioning the refrigerant outlet tube in thermal contact with an upper portion of the housing to control condensing of vapor refrigerant within the housing to thereby stabilize refrigerant flow.

Considered in different terms, the method for stabilizing refrigerant flow preferably comprises the steps of: providing a greater amount of cooling adjacent an upper portion of the housing to more rapidly condense vapor refrigerant responsive to a level of liquid refrigerant in the housing being relatively low; and providing a lesser amount of cooling adjacent an upper portion of the housing to less rapidly condense vapor refrigerant responsive to a level of liquid refrigerant in the housing being relatively high. Accordingly, more stable control of refrigerant flow throughout the heat pump apparatus may be enjoyed.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, applicant provides these embodiments so that this disclosure will be thorough and complete, and will fully convey the scope of the invention to those skilled in the art. Like numbers refer to like elements throughout.

Figures 1, 2:
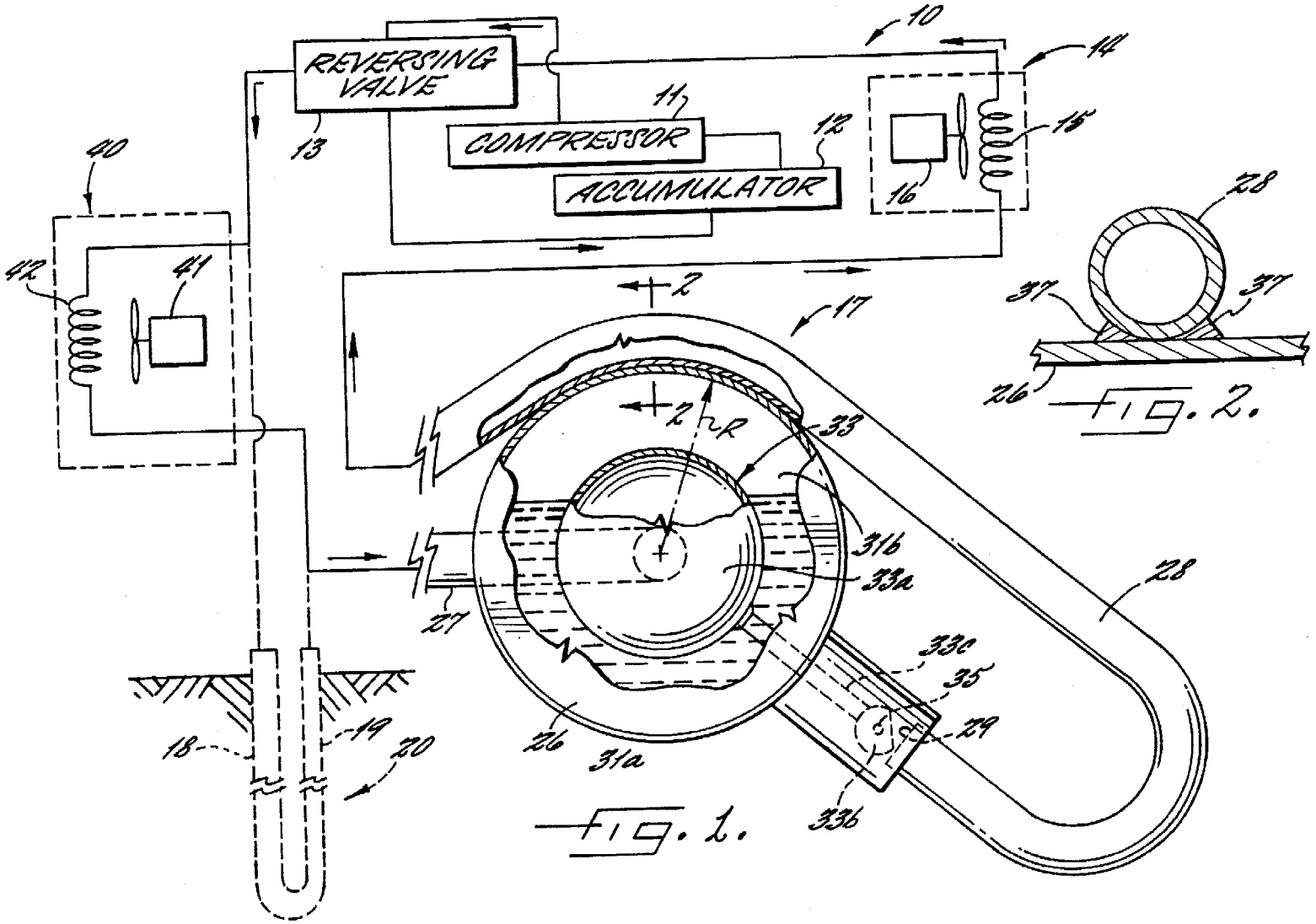
FIG. 1 is a schematic diagram of a heat pump apparatus and including a fragmentary view of the liquid refrigerant flow control valve in accordance with the present invention.
FIG. 2 is an enlarged cross-sectional view of the liquid refrigerant flow control valve and refrigerant outlet tube as taken along lines 2—2 of FIG. 1.

Referring initially to FIG. 1, an embodiment of the heat pump apparatus 10 and including a liquid refrigerant flow control valve 17 for enhancing stability of refrigerant flow in accordance with the invention is first described. The heat pump apparatus 10 includes an air handler 14 including a blower 16 and a first heat exchanger 15 as would be readily understood by those skilled in the art. In addition, the illustrated heat pump apparatus 10 includes a compressor 11, and a refrigerant accumulator 12. A refrigerant charge control device may be used in place of a conventional accumulator 12 as disclosed in U.S. Pat. Nos. 4,665,716 and 4,573,327, assigned to the assignee of the present invention, and the entire disclosures of which are incorporated herein by reference. The refrigerant charge control device is helpful in maintaining a desired quantity of refrigerant in active circulation within the heat pump apparatus 10. In addition, the illustrated heat pump apparatus 10 includes a conventional reversing valve 13 for permitting selective operation of the apparatus in either a heating or cooling mode, as would be readily understood by those skilled in the art.

As would also be readily understood by those skilled in the art, the compressor 11 circulates refrigerant through both the first heat exchanger 15 and through the illustrated conventional refrigerant-to-air heat exchanger 40 which, in turn, includes a blower 41 and heat exchanger coils 42. As would also be readily understood by those skilled in the art, the liquid refrigerant flow control valve 17 providing enhanced stability may have even greater applicability when used in an air source heat pump apparatus including a refrigerant-to-air heat exchanger 40. The refrigerant passing through a refrigerant-to-air heat exchanger 40 may experience a change in temperature of several degrees in just a few seconds as may be caused by a gust of wind, for example. The change in temperature may cause a large change in the proportion of liquid and vapor refrigerant delivered to the liquid refrigerant flow control valve 17. As explained in greater detail below, the liquid flow control valve 17 in accordance with the present invention may readily counteract such a disturbance.

The apparatus may also optionally include an earth tap heat exchanger 20 shown in broken lines. Although one earth tap heat exchanger 20 is illustrated, a plurality of earth taps may be used via a suitable manifold. The illustrated earth tap heat exchanger 20 includes a vapor conduit 18 and an adjacent liquid conduit 19 connected together at their respective lower ends. The earth tap heat exchanger 20 may be buried in soil, positioned partly in water and soil, or positioned entirely in a body of water if nearby.

When the heat pump apparatus 10 is operating in the heating mode, liquid refrigerant is delivered to the upper end of the liquid carrying conduit 19 and proceeds downward therethrough, and enters the lower end portion of the vapor refrigerant conduit 18. The liquid refrigerant evaporates within the vapor refrigerant conduit 18, thereby extracting heat from the surrounding soil or water. Ideally, when the heat pump apparatus 10 is operating in the cooling mode, hot refrigerant vapor is delivered to the upper end of the vapor refrigerant conduit 18, flows downward therethrough and condenses to liquid, which, in turn, is withdrawn from the liquid carrying conduit 19. The hot refrigerant vapor transfers heat to the surrounding earth or soil.

For clarity of explanation, the heat pump apparatus 10 illustrated in FIG. 1 includes solid directional arrows indicating the flow of refrigerant when the heat pump 10 is in the cooling mode. Accordingly, the refrigerant-to-air heat exchanger 40 or earth tap heat exchanger 20 is operating as a condenser, while the other heat exchanger 15 is operating as an evaporator as will be readily appreciated by those skilled in the art. The following description is based upon operation in the cooling mode, although those of skill in the art will readily appreciate the details of operation in the heating mode.

The liquid refrigerant flow control valve 17 controls the flow of liquid refrigerant from the condenser and to the evaporator for high efficiency operation of the heat pump apparatus 10. The valve 17 includes a housing 26, a refrigerant inlet tube 27, and a refrigerant outlet tube 28 in fluid communication with an interior defined by the housing. A baffle, not shown, may be positioned adjacent the refrigerant inlet to prevent the incoming flow of refrigerant from disturbing the float 33 among other purposes, as will be readily appreciated by those of skill in the art.

The refrigerant outlet tube 28 is also positioned in thermal contact with an upper portion of the valve housing 26 for cooling and condensing vapor refrigerant in the upper portion of the housing to thereby stabilize refrigerant flow as described in greater detail below. By positioned in thermal contact is meant capable of effectively transferring heat. For a metal housing 26 and metal refrigerant outlet tube 28, physical contact between the two provides sufficient thermal contact for stable operation of the liquid refrigerant flow control valve 17.

The housing 26 contains both liquid refrigerant 31*a* and vapor refrigerant 31*b* above the liquid refrigerant. The housing 26 may have a generally cylindrical shape as in the illustrated embodiment with an axis of the housing positioned to lie in a generally horizontal direction. Other housing shapes are also possible including rectangular, or more complex shapes, for example, as would be readily understood by those skilled in the art.

As shown with reference to FIG. 2, the housing 26 of the liquid refrigerant flow control valve 17 may be further joined to the contacting refrigerant outlet tube 28 by a solder or brazing alloy 37 which fills a portion of the spaces between adjacent portions of the housing and refrigerant outlet tube. The solder or brazing alloy 37 not only ensures strength of the connection, but also provides additional thermal contact between the upper portion of the housing 26 and the refrigerant outlet tube 28.

The flow control valve 17 also includes a float 33, in turn, comprising a body portion 33*a* and a metering portion 33*b* connected together by the illustrated shaft 33*c*. The metering portion 33*b* is pivotally connected to an extended portion of the housing 26 by a hinge pin 35 as shown in the illustrated embodiment. The illustrated body portion 33*a* is in the form of a sphere, but other shapes are also contemplated by the invention as will be appreciated by those skilled in the art.

Figure 3:
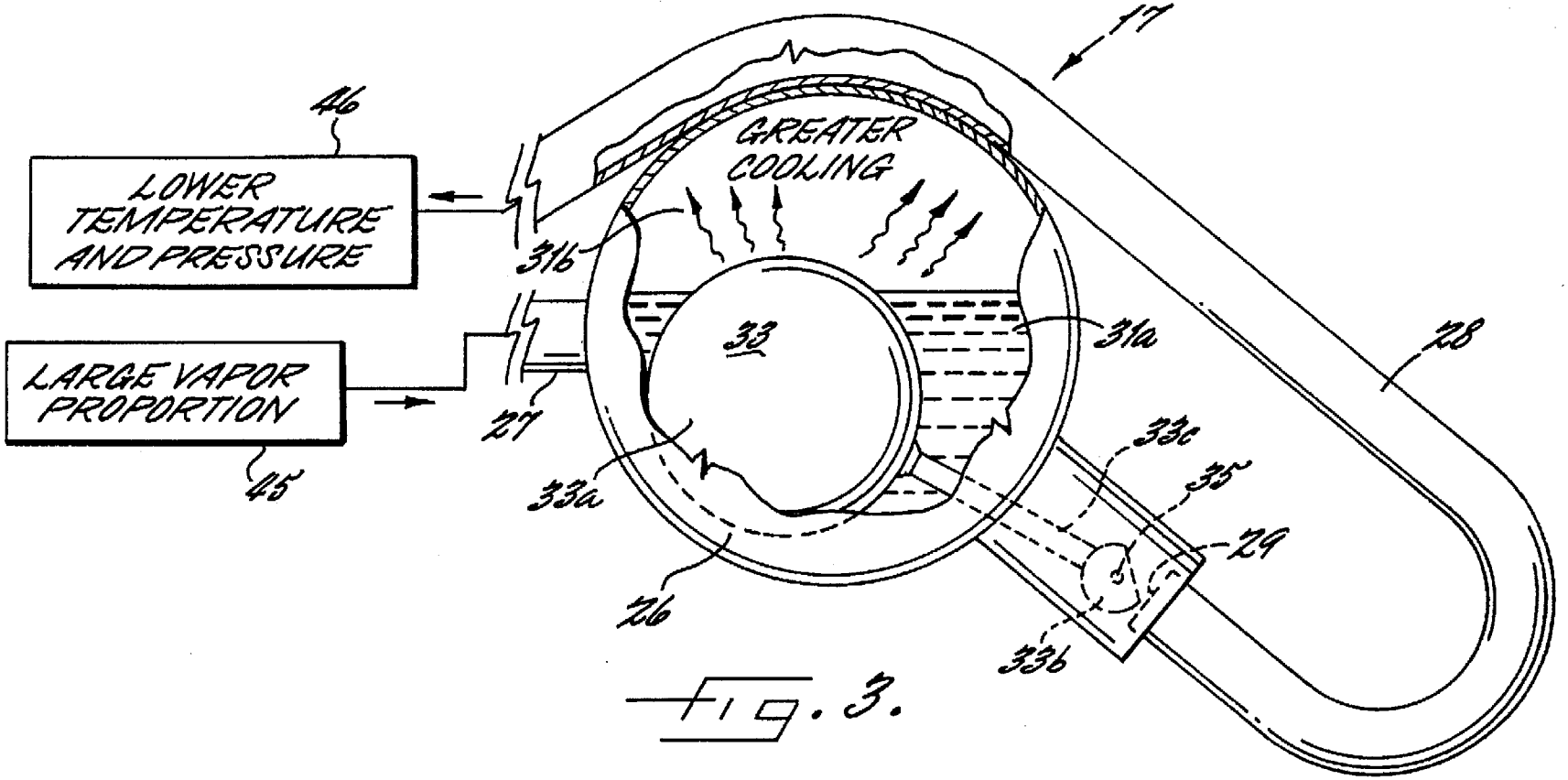
FIG. 3 is a schematic fragmentary view of the liquid refrigerant flow control valve illustrating a relatively large proportion of refrigerant vapor within the valve housing.
Figure 4:
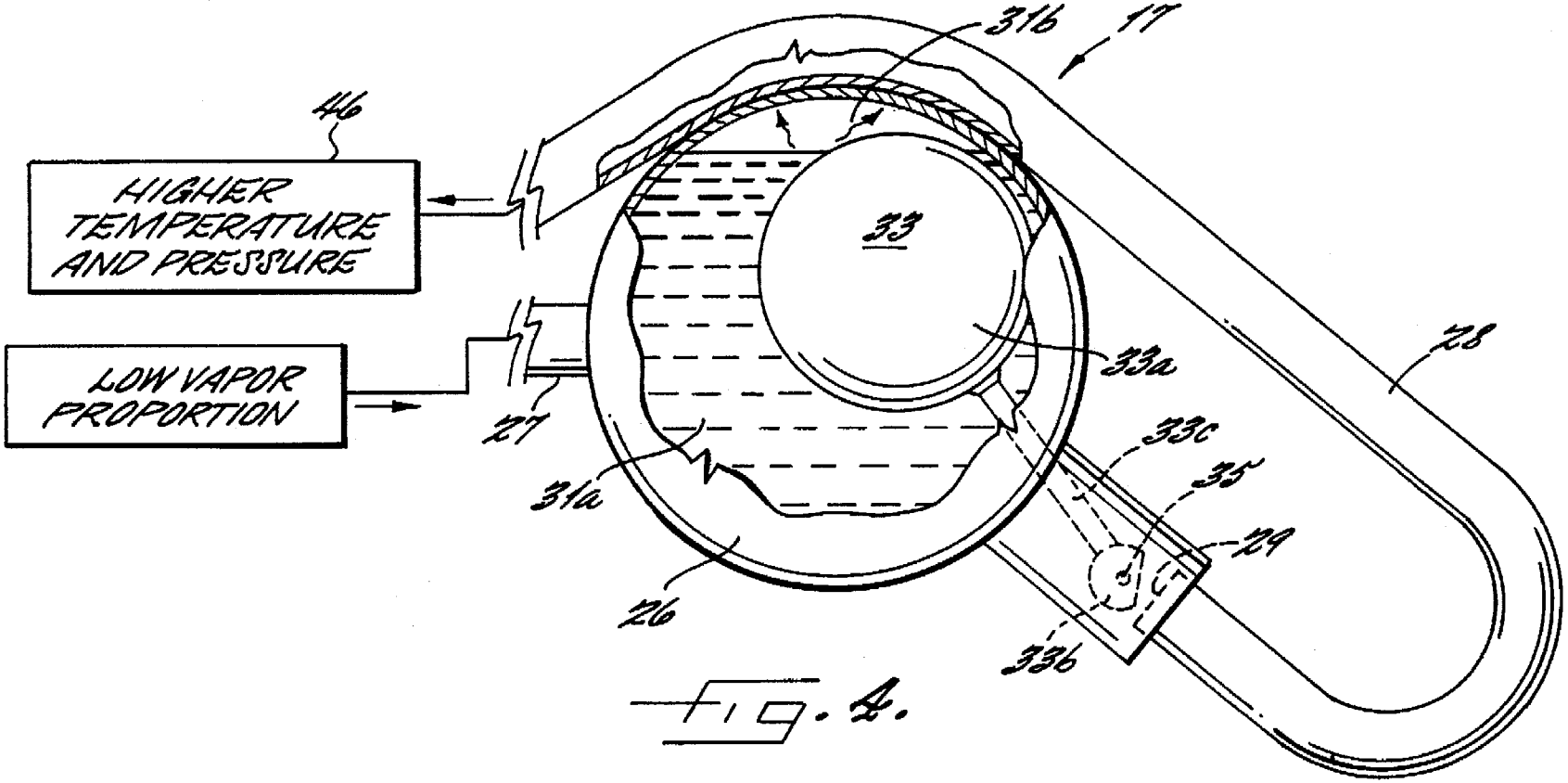
FIG. 4 is a schematic fragmentary view of the liquid refrigerant flow control valve illustrating a relatively low proportion of refrigerant vapor within the valve housing.

Referring now additionally to FIGS. 3 and 4 operation of the liquid flow control valve 17 is further explained. As illustrated schematically in FIG. 3, when a large amount of vapor refrigerant arrives at the inlet of the liquid flow control valve 17 from the upstream portion of the heat pump apparatus 45 as a result of a system disturbance, for example, the float 33 pivots or moves downwardly, thereby reducing refrigerant flow through the expansion orifice 29. Accordingly, the pressure drops in the heat pump apparatus 46 downstream from the valve 17 and the temperature in the outlet tube 28 also lowers. The cooler outlet tube 28 provides a greater amount of cooling and thus lowers the temperature of the upper portion of the housing 26 which, in turn, cools and condenses more vapor 31*b* than would otherwise be cooled and condensed. In addition, the excess vapor increases the vapor-to-housing contact area within the housing 26 further enhancing condensation of excess vapor. The liquid flow control valve 17 thus quickly dissipates the excess vapor and provides more stable operation to prevent excessive overshooting or hunting.

Conversely, as shown in FIG. 4, when an oscillation or disturbance of the heat pump apparatus portion 45 causes less vapor refrigerant to arrive at the liquid flow control valve 17, the liquid level rises in the housing and causes the float 33 to rise. The expansion orifice 29 releases more refrigerant, thereby increasing the pressure and temperature of the refrigerant outlet tube 28 and downstream portion of the heat pump apparatus 46. The refrigerant outlet tube 28 in this scenario provides less cooling or warms the upper portion of the housing 26 and thus condenses vapor 31*b* in the housing more slowly, thus allowing the vapor volume in the housing to increase. Accordingly, the liquid flow control valve 17 provides stability when a system disturbance causes a reduced amount of vapor to arrive at the liquid flow control valve. Considered in somewhat different terms, the liquid refrigerant flow control valve 17 provides a compensating action in the form of negative or inverse feedback to a destabilizing disturbance or oscillation.

As shown in the illustrated embodiment, the refrigerant outlet tube 28 preferably contacts an upper exterior surface of the housing 26. In addition, the refrigerant outlet tube 28 extends outwardly from a lower portion of the housing 26 and extends upwardly and in spaced relation therefrom before contacting an upper exterior surface of the housing. In other words, the configuration of the housing 26 and the refrigerant outlet tube 28 give the appearance of a scorpion, wherein the outlet tube is the scorpion tail. It will be also understood by those skilled in the art that the refrigerant outlet tube 28 once separated downstream from the housing 26 may be routed along any convenient path for connection to the evaporator. Also, the refrigerant outlet tube 28 may be provided by a plurality of individuals sections joined by conventional couplings, not shown, as would also be readily understood by those skilled in the art.

The upper portion of the housing 26 may be arcuate as illustrated having a predetermined radius of curvature R (FIG. 1). In addition, the refrigerant outlet tube 28 preferably contacts the arcuate upper portion of the housing 26 along a length in a range of about ½ to 3 times the predetermined radius of curvature R, and more preferably about two times the radius of curvature. The contact position or extent of the refrigerant outlet tube 28 may be centered on the housing 26 as shown in the illustrated embodiment (FIG. 1). For example, for a housing 26 having a radius of curvature of about 1.5 inches, the contact area between the housing and the refrigerant outlet tube 28 may be about 3 inches centered on the housing.

A method aspect of the present invention is for stabilizing refrigerant flow through a liquid refrigerant flow control valve 17 connected in fluid communication between a condenser 40 and an evaporator 14 of a heat pump apparatus 10 as shown in FIG. 1 and described in greater detail above. The liquid flow control valve 17 comprises a housing 26 for containing liquid refrigerant 31*a* and vapor refrigerant 31*b* above the liquid refrigerant, and a float 33 movable within the housing and cooperating with an expansion orifice 29 for controlling a flow of refrigerant passing through the expansion orifice and thus from the housing to the evaporator based upon a level of liquid refrigerant within the housing. The method preferably includes the steps of: connecting a refrigerant outlet tube 28 in fluid communication with the expansion orifice 29, and positioning the refrigerant outlet tube 28 in thermal contact with an upper portion of the housing 26 for variably cooling and condensing vapor refrigerant 31*b* to thereby stabilize refrigerant flow.

The step of positioning the refrigerant outlet tube 28 comprises positioning same to contact an upper exterior surface of the housing 26 in the illustrated embodiment, although those of skill in the art will recognize that other configurations are possible. For example, the refrigerant outlet tube 28 may be routed through an interior of the housing, although the exterior configuration may be simpler and thus less expensive.

The step of positioning the refrigerant outlet tube 28 may also include positioning same to extend outwardly from a lower portion of the housing 26 and extend upwardly and in spaced relation therefrom before contacting an upper exterior surface of the housing. The upper portion of the housing 26 may be arcuate having a predetermined radius of curvature R (FIG. 1) and the step of positioning the refrigerant outlet tube may comprise positioning same to contact the arcuate upper portion of the housing along a length in a range of about ½ to 3 times the predetermined radius of curvature, such as about two times the predetermined radius of curvature.

Considered in other terms, the method for stabilizing refrigerant flow may preferably comprise the steps of: providing a greater amount of cooling adjacent an upper portion of the housing 26 to more rapidly condense vapor refrigerant 31*b* responsive to a level of liquid refrigerant in the housing being relatively low; and providing a lesser amount of cooling adjacent an upper portion of the housing to less rapidly condense vapor refrigerant responsive to a level of liquid refrigerant in the housing being relatively high. The step of providing a greater amount of cooling comprises the steps of: connecting a refrigerant outlet tube 28 in fluid communication with the expansion orifice 29; positioning the refrigerant outlet tube in thermal contact with an upper portion of the housing 26 for controlling condensing of vapor refrigerant within the housing to thereby stabilize refrigerant flow; and releasing a lesser amount of liquid refrigerant through the expansion orifice to the refrigerant outlet tube. Conversely, the step of providing a lesser amount of cooling comprises releasing a greater amount of liquid refrigerant through the expansion orifice 29 to the refrigerant outlet tube 28 as described in greater detail above.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. A heat pump apparatus comprising:

a condenser, an evaporator, and a compressor for circulating refrigerant through said condenser and said evaporator; and a liquid refrigerant flow control valve connected in fluid communication between said condenser and said evaporator, said liquid refrigerant flow control valve comprising a housing for containing liquid refrigerant and vapor refrigerant above the liquid refrigerant, orifice defining means for defining an expansion orifice for refrigerant, a float movable within said housing and cooperating with said orifice defining means for controlling a flow of refrigerant passing through said expansion orifice based upon a level of liquid refrigerant within said housing, and a refrigerant outlet tube connected in fluid communication with the expansion orifice and positioned in thermal contact with an upper portion of said housing for controlling condensing of vapor refrigerant within said housing to thereby stabilize refrigerant flow.

2. A heat pump apparatus according to claim 1 wherein said refrigerant outlet tube contacts an upper surface of said housing.

3. A heat pump apparatus according to claim 1 wherein said refrigerant outlet tube contacts an upper exterior surface of said housing.

4. A heat pump apparatus according to claim 3 wherein said refrigerant outlet tube extends outwardly from a lower portion of said housing and extends upwardly and in spaced relation therefrom before contacting the upper exterior surface of said housing.

5. A heat pump apparatus according to claim 1 further comprising thermally conductive filler material positioned between adjacent portions of said refrigerant outlet tube and said housing.

6. A heat pump apparatus according to claim 1 wherein an upper portion of said housing is arcuate having a predetermined radius of curvature.

7. A heat pump apparatus according to claim 6 wherein said refrigerant outlet tube contacts the arcuate upper portion of said housing along a length in a range of about ½ to 3 times the predetermined radius of curvature.

8. A heat pump apparatus according to claim 6 wherein said refrigerant outlet tube contacts the arcuate upper portion of said housing along a length of about two times the predetermined radius of curvature.

9. A heat pump apparatus according to claim 1 wherein said housing has a cylindrical shape with an axis aligned in a generally horizontal direction.

10. A heat pump apparatus according to claim 1 wherein said float comprises a body portion and a metering portion connected thereto.

11. A heat pump apparatus according to claim 1 further comprising a refrigerant inlet tube connected in fluid communication between said condenser and said housing.

12. A heat pump apparatus according to claim 1 wherein one of said condenser and said evaporator comprises a refrigerant-to-air heat exchanger.

13. A heat pump apparatus according to claim 1 wherein one of said condenser and said evaporator comprises an earth tap heat exchanger positioned in soil or water.

14. A heat pump apparatus according to claim 1 further comprising reversing valve means for permitting selective operation of the heat pump apparatus in one of a cooling mode and a heating mode.

15. A liquid refrigerant flow control valve for controlling a flow of refrigerant from a condenser to an evaporator of a heat pump apparatus, the liquid refrigerant flow control valve comprising:

a housing for containing liquid refrigerant and vapor refrigerant above the liquid refrigerant;

orifice defining means for defining an expansion orifice for refrigerant;

a float movable within said housing and cooperating with said orifice defining means for controlling a flow of refrigerant passing through the expansion orifice based upon a level of liquid refrigerant within said housing; and a refrigerant outlet tube connected in fluid communication with the expansion orifice and positioned in thermal contact with an upper portion of said housing for controlling condensing of vapor refrigerant within said housing to thereby stabilize refrigerant flow.

16. A liquid refrigerant flow control valve according to claim 15 wherein said refrigerant outlet tube contacts an upper surface of said housing.

17. A liquid refrigerant flow control valve according to claim 15 wherein said refrigerant outlet tube contacts an upper exterior surface of said housing.

18. A liquid refrigerant flow control valve according to claim 17 wherein said refrigerant outlet tube extends outwardly from a lower portion of said housing and extends upwardly and in spaced relation therefrom before contacting the upper exterior surface of said housing.

19. A liquid refrigerant flow control valve according to claim 15 further comprising thermally conductive filler material positioned between adjacent portions of said refrigerant outlet tube and said housing.

20. A liquid refrigerant flow control valve according to claim 15 wherein an upper portion of said housing is arcuate having a predetermined radius of curvature.

21. A liquid refrigerant flow control valve according to claim 20 wherein said refrigerant outlet tube contacts the arcuate upper portion of said housing along a length in a range of about ½ to 3 times the predetermined radius of curvature.

22. A liquid refrigerant flow control valve according to claim 20 wherein said refrigerant outlet tube contacts the arcuate upper portion of said housing along a length of about two times the predetermined radius of curvature.

23. A liquid refrigerant flow control valve according to claim 15 wherein said housing has a cylindrical shape with an axis aligned in a generally horizontal direction.

24. A liquid refrigerant flow control valve according to claim 15 wherein said float comprises a body portion and a metering portion connected thereto.

25. A liquid refrigerant flow control valve according to claim 15 wherein said housing further comprises a refrigerant inlet to be connected in fluid communication with the condenser.

26. A liquid refrigerant flow control valve for controlling a flow of refrigerant from a condenser to an evaporator of a heat pump apparatus, the liquid refrigerant flow control valve comprising:

a housing for containing liquid refrigerant and vapor refrigerant above the liquid refrigerant;

float means for controlling a flow of refrigerant passing from said housing to the evaporator based upon a level of liquid refrigerant within said housing; and a refrigerant outlet tube connected in fluid communication with said housing and positioned in contact with an upper portion of said housing.

27. A liquid refrigerant flow control valve according to claim 26 wherein said refrigerant outlet tube contacts an exterior upper portion of said housing, and further comprising thermally conductive filler material positioned between adjacent portions of said refrigerant outlet tube and said housing.

28. A liquid refrigerant flow control valve according to claim 26 wherein said refrigerant outlet tube extends outwardly from a lower portion of said housing and extends upwardly and in spaced relation therefrom before contacting an upper exterior surface of said housing.

29. A liquid refrigerant flow control valve according to claim 26 wherein an upper portion of said housing is arcuate having a predetermined radius of curvature.

30. A liquid refrigerant flow control valve according to claim 29 wherein said refrigerant outlet tube contacts the arcuate upper portion of said housing along a length in a range of about ½ to 3 times the predetermined radius of curvature.

31. A liquid refrigerant flow control valve according to claim 29 wherein said refrigerant outlet tube contacts the arcuate upper portion of said housing along a length of about two times the predetermined radius of curvature.

32. A liquid refrigerant flow control valve according to claim 26 wherein said housing has a cylindrical shape with an axis aligned in a generally horizontal direction.

33. A method for stabilizing refrigerant flow through a liquid refrigerant flow control valve connected in fluid communication between a condenser and an evaporator of a heat pump apparatus, the liquid flow control valve comprising a housing for containing liquid refrigerant and vapor refrigerant above the liquid refrigerant, a float movable within the housing for controlling a flow of refrigerant passing through an expansion orifice based upon a level of liquid refrigerant within the housing, the method comprising the steps of:

connecting a refrigerant outlet tube in fluid communication with the expansion orifice; and positioning the refrigerant outlet tube in thermal contact with an upper portion of the housing for controlling condensing of vapor refrigerant within the housing to thereby stabilize refrigerant flow.

34. A method according to claim 33 wherein the step of positioning the refrigerant outlet tube comprises positioning same to contact an upper surface of the housing.

35. A method according to claim 33 wherein the step of positioning the refrigerant outlet tube comprises positioning same to contact an upper exterior surface of the housing.

36. A method according to claim 35 wherein the step of positioning the refrigerant outlet tube comprises positioning same to extend outwardly from a lower portion of the housing and extend upwardly and in spaced relation therefrom before contacting the upper exterior surface of the housing.

37. A method according to claim 33 further comprising the step of positioning thermally conductive filler material between adjacent portions of the refrigerant outlet tube and the housing.

38. A method according to claim 33 wherein an upper portion of the housing is arcuate having a predetermined radius of curvature; and wherein the step of positioning the refrigerant outlet tube comprises positioning same to contact the arcuate upper portion of said housing along a length in a range of about ½ to 3 times the predetermined radius of curvature.

39. A method according to claim 38 wherein the step of positioning the refrigerant outlet tube comprises positioning same to contact the arcuate upper portion of said housing along a length of about two times the predetermined radius of curvature.

40. A method for stabilizing refrigerant flow through a liquid refrigerant flow control valve connected in fluid communication between a condenser and an evaporator of a heat pump apparatus, the liquid flow control valve comprising a housing for containing liquid refrigerant and vapor refrigerant above the liquid refrigerant, and a float movable within the housing for controlling a flow of refrigerant passing through an expansion orifice based upon a level of liquid refrigerant within the housing, the method comprising the steps of:

providing a greater amount of cooling adjacent an upper portion of the housing to more rapidly condense vapor refrigerant responsive to a level of liquid refrigerant in the housing being relatively low; and providing a lesser amount of cooling adjacent an upper portion of the housing to less rapidly condense vapor refrigerant responsive to a level of liquid refrigerant in the housing being relatively high.

41. A method according to claim 40 wherein the step of providing a greater amount of cooling comprises the steps of:

connecting a refrigerant outlet tube in fluid communication with the expansion orifice;

positioning the refrigerant outlet tube in thermal contact with an upper portion of the housing for controlling condensing of vapor refrigerant within the housing to thereby stabilize refrigerant flow; and releasing a lesser amount of liquid refrigerant through the expansion orifice to the refrigerant outlet tube.

42. A method according to claim 40 wherein the step of providing a lesser amount of cooling comprises the steps of:

connecting a refrigerant outlet tube in fluid communication with the expansion orifice;

positioning the refrigerant outlet tube in thermal contact with an upper portion of the housing for controlling condensing of vapor refrigerant within the housing to thereby stabilize refrigerant flow; and releasing a greater amount of liquid refrigerant through the expansion orifice to the refrigerant outlet tube.

* * * * *